United States Patent [19]

Russell

[11] 4,147,998

[45] Apr. 3, 1979

[54] BEAM LEAD ROD ASSEMBLY

[75] Inventor: Thomas J. Russell, Sunnyvale, Calif.

[73] Assignee: Krytar, Sunnyvale, Calif.

[21] Appl. No.: 817,185

[22] Filed: Jul. 20, 1977

[51] Int. Cl.[2] ..... H01P 3/06; H01P 1/00; H01P 11/00; H01P 5/04

[52] U.S. Cl. ..... 333/238; 29/601; 29/626; 333/243; 333/240; 357/79

[58] Field of Search ..... 333/97 R, 97 S, 84 R, 333/84 M, 31 R, 70, 96; 361/399–406, 417–422; 357/79–80; 331/107 R, 107 G, 107 T, 96, 101; 330/5, 4.9, 57, 56; 307/317 R, 317 A, 318, 320, 321–325; 29/600, 591, 601, 624–626

[56] References Cited

U.S. PATENT DOCUMENTS

| | | | |
|---|---|---|---|
| 3,119,053 | 1/1964 | Yazawa | 357/80 X |
| 3,842,359 | 10/1974 | Dickens | 330/56 X |
| 3,903,488 | 9/1975 | Fong | 333/84 M X |
| 3,961,415 | 6/1976 | Davis, Jr. | 357/80 X |

OTHER PUBLICATIONS

Wylie, "Selective Flow Coating of Thin Film Integrated Circuits", in Western Electric Technical Digest, No. 36, Oct. 1974, pp. 33–34.

Dion et al., "Module Package", in IBM Technical Disclosure Bulletin, vol. 7, No. 7, Dec. 1964, p. 557.

*Primary Examiner*—Alfred E. Smith
*Assistant Examiner*—Marvin Nussbaum
*Attorney, Agent, or Firm*—Lowhurst & Aine

[57] ABSTRACT

A beam lead rod assembly for incorporation into an electromagnetic wave coaxial transmission line structure. The rod assembly comprises a beam lead holder and a beam lead device. The holder includes a cylindrical body of a dielectric material and a conductive coating surrounding each end portion of the body for conductively connecting each side of the body to a different portion of the transmission line. The conductive regions are separated by a circumferential gap so that there is no conduction between the two conductive regions. The beam lead device is disposed across the gap with opposite beam leads being conductively connected to opposite conductive regions.

10 Claims, 8 Drawing Figures

BEAM LEAD ROD ASSEMBLY

BACKGROUND OF THE INVENTION

This invention relates generally to coaxial transmission line structures for the propagation of electromagnetic waves, such as microwaves, and more particularly to interconnecting a beam lead semiconductor device into such a structure. Further, this invention relates to a beam lead rod assembly utilizing a beam lead semiconductor device which allows the standardization of interconnecting such a device into a coaxial structure, such as into a gap formed in the center conductor of a coaxial structure by connecting opposite ends of the rod assembly to the end portions of the center conductor defining the gap therebetween or between the outer and the center conductor.

It is well-known that in certain microwave applications, utilizing a semiconductor device, the circuit broadband frequency response is limited by the parasitic reactances of the device package. For example, the high frequency limit of the useful frequency range of a broadband microwave detector, using a point contact diode, is usually limited by the parasitic reactances of the diode package.

While devices such as point contact diodes have performed reliably in the past, there has been developed a new and different kind of semiconductor device which is much more broadband, such as a beam lead rectifier. Parasitic reactances of a beam lead semiconductor device are usually quite low. Generally speaking, beam lead devices are semiconductor devices with beam leads that have been formed by electrodeposited gold. These leads make contact to the semiconductor chip and typically extend 10 mils, in opposite directions, from the chip. Therefore, the beam leads form the connections to the chip, eliminating the often difficult problem of making contact with the chip. Beam lead devices require very careful handling to avoid damaging the thin beam leads.

Because of their planar type construction, beam lead devices are very compatible with, and have been widely used in, microwave circuits where the circuit is etched on a planar microstrip substrate. The beam lead device can be mounted directly to the planar circuit on the substrate by thermocompression bonding.

Beam lead devices have generally been found not only to be more broadband, but to have more repeatable electric characteristics and to be more rugged than, for example, point contact diodes, and therefore are very desirable for incorporation as the active element in coaxial structures. However, beam lead semiconductor devices, including beam lead diodes, are extremely small in size and the handling of such beam lead devices must be done with great care. The leads are easily distorted or broken by the normal pressure or squeeze handling and most vacuum pencil tips are too large and the vacuum pencils may draw the diode into the vacuum system. Accordingly, it is of utmost importance that a package be found that not only allows the beam lead device to be properly mounted, but that is also compatible with standardization so that a beam lead diode may be incorporated into a coaxial structure, and that also has low parasitic reactance.

Beam lead Schottky diodes, beam lead PIN diodes, and beam lead capacitors, are typical beam lead semiconductor devices that can be used in the beam lead rod assembly of this invention. It is to be understood that the rod assembly can use any and all other type beam lead devices for a multitude of applications. One of the primary usefulnesses of the package of the present invention is the ease in which it can be incorporated into a coaxial structure.

Accordingly, one of the objects of this invention is to provide a package which may be placed in series with the center conductor of a coaxial structure and which can hold any beam lead semiconductor device.

It is a further object of this invention to provide a package for incorporation as an element into a coaxial structure, either in series or in parallel or as a termination, which is particularly applicable for housing beam lead semiconductor devices.

It is still another object of this invention to provide a convenient holder for a beam lead semiconductor device which allows for standardization of connections thereto.

SUMMARY OF THE INVENTION

The above objects are realized by providing a rod-like dielectric body and coating opposite ends with a conductive material which are separated by a circumferential gap which is nonconductive. A semiconductor device, such as for example a beam lead diode, is placed to straddle the gap and has opposite beam leads conductively connected to opposite conductive coatings. The rod assembly can easily be incorporated in a coaxial transmission line because opposite cylindrical ends of the rod assembly fit readily into cylindrical bores which are relatively easy to provide in coaxial structures.

DETAILED DESCRIPTION OF THE PREFERRED EMBODIMENT

Figure 1:
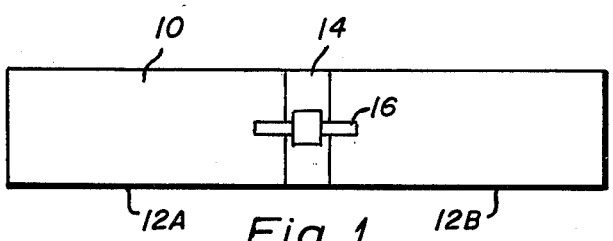
FIG. 1 is an elevational view of the beam lead rod assembly of this invention illustrating a beam lead device carrier and a beam lead device mounted thereon.
Figure 2:
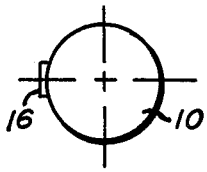
FIG. 2 is an end view of the beam lead rod assembly of FIG. 1.
Figure 7:
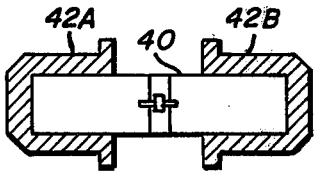
FIG. 7 is a view, partly in cross-section, of the beam lead rod assembly of this invention having a pair of metal caps over its end portions to physically resemble a commonly used diode package.

Referring now to FIG. 1 and 2 of the drawing, there is shown a rod-like body 10, cylindrical in shape, of an insulator material such as a plastic or ceramic which forms the beam lead carrier or holder of this invention. Carrier 10 may be of any convenient length and diameter, but for use in a coaxial transmission line and to physically resemble the commonly known Alpha microwave diode package No. 013-001, as illustrated in FIG. 7, the selected dimensions are 0.17 inches long and 0.040 inches in diameter. Carrier 10 is provided with a conductive coating 12A on one end portion and coating 12B on the other end portion and the two coatings define a gap 14 therebetween. The coating is typically 0.0005–0.001 inches thick and may be obtained, in case of a plastic rod such as Rexolite, by metallically plating the entire body of rod 10, and forming the gap 14, typically 0.015 inches wide, by removing the metal on a lathe. The metallic plating is typically gold over copper. In case of a ceramic rod, which is preferable for high temperature applications, the rod could be selectively plated to form gap 14.

Figure 3A:
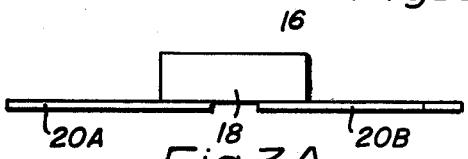
FIGS. 3A and 3B are, respectively, an elevational view and a top view of a typical beam lead device.
Figure 3B:
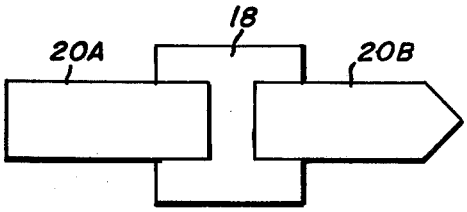

Referring now to FIGS. 3A and 3B, there is shown a typical beam lead diode 16 which body 10 is to hold. Diode 16 consists of a semiconductor diode chip 18, typically 0.010 inches square, which determines the minimum width of gap 14 because it must fit into the gap without touching the conductive coatings. The beam leads 20A and 20B on either side of diode body 18 have a length of approximately 0.010 inches which determine the maximum width of gap 14. The thickness of the beam leads are typically 0.0004 inches which make the device so fragile and difficult to handle and the height of chip 18 is typically 0.003 inches.

Referring once more to FIG. 1, there is also shown a beam lead diode 16 mounted on carrier 10, diode chip 18 being well within gap 14, and leads 20A and 20B being conductively connected to coating sections 12A and 12B, respectively. With a plastic rod carrier 10, a preferred method of attachment is to connect beam leads 20A and 20B to coating sections 12A and 12B with a conductive epoxy. If a ceramic carrier rod 10 is used, these connections can be made with conductive epoxy or thermocompression bonding. To protect the beam lead device an epoxy coating can be applied over it, after mounting it on carrier 10.

Figure 4:
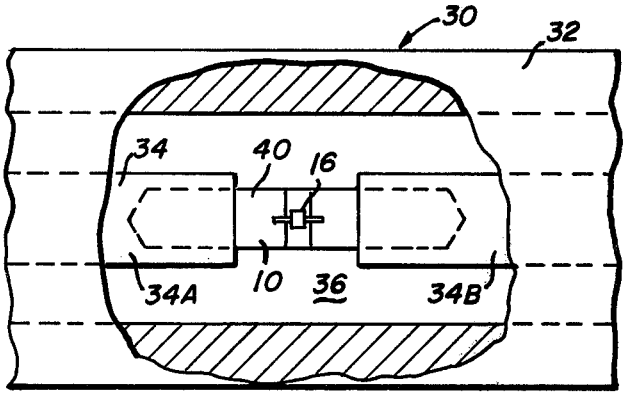
FIG. 4 is a partial cross-sectional view of a coaxial line utilizing the beam lead rod assembly of this invention, in series with the center conductor.
Figure 5:
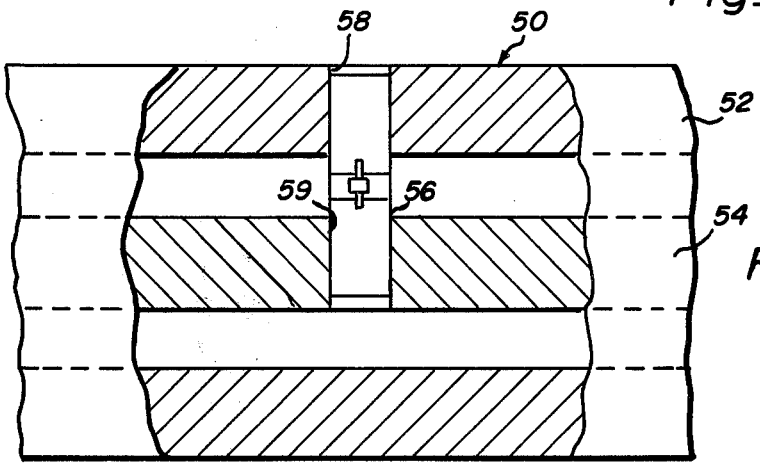
FIG. 5 is a partial cross-sectional view of a coaxial line using the beam lead rod assembly of this invention connected between the center and outer conductor.
Figure 6:
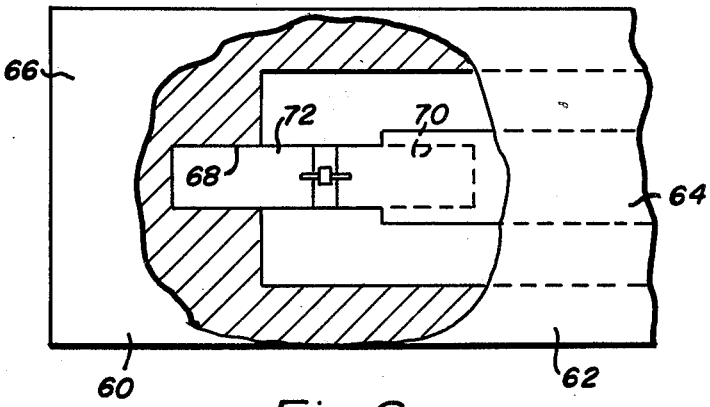
FIG. 6 is a partial cross-sectional view of a coaxial line using this beam lead rod assembly of the invention as a line termination.

The beam lead rod assembly of this invention, comprised of carrier or rod 10 and beam lead device 16 mounted thereon, is ideally suited for interconnecting into a coaxial line, either in series with the center conductor as shown in FIG. 4, or across the center and the outer conductor as shown in FIG. 5, or even as the termination as shown in FIG. 6.

Referring now to FIG. 4, there is shown a coaxial transmission line 30 having an outer conductor 32 and a center conductor 34. Center conductor 34 has a spaced apart portion 34A and 34B which form a gap 36 therebetween. Each end portion 34A and 34B is provided with an axial bore which is dimensioned to accommodate respective conductive end portions of the beam lead rod assembly 40, constructed in accordance with the present invention and comprised of rod 10 and beam lead device 16 mounted thereon. Instead of providing bores in end portions 34A and 34B, a pair of caps 42A and 42B, as shown in FIG. 7, could be placed about each conductive end portion of beam lead rod assembly 40 to provide a standard configuration which physically resembles a commonly used diode package. The caps can then be inserted into appropriately dimensioned bores in the end portions of center conductor portions 34A and 34B, as shown in FIG. 4.

Referring now to FIG. 5, there is shown a coaxial transmission line 50 comprising an outer conductor 52 and a center conductor 54 and a beam lead rod assembly 56, constructed in accordance with the invention. Rod assembly 56 connects the outer conductor with the center conductor by having one end portion inserted into a bore 58 in outer conductor 50 and the other end portion inserted into a bore 59 in center conductor 54. It should be noted that the cylindrical configuration of package 56 is ideally suited for connecting the outer and the center conductor of a coaxial transmission line.

Referring now to FIG. 6, there is shown a coaxial transmission line 60 comprised of an outer conductor 62 and a center conductor 64, the outer conductor being terminated by an end portion 66. End portion 66 is provided with a bore 68 and end portion of center conductor 64 is provided with a bore 70, each being dimensioned to accommodate beam lead rod assembly 72 constructed in accordance with the present invention. Again, the cylindrical form of the package is ideally suitable for terminating a coaxial line.

FIG. 7 shows the use of metallic caps 42A and 42B over the conductive end portions of package 40 so that the assembly physically emulates the well-known Alpha microwave diode package No. 013-001. It is to be understood that many other commonly known packages can likewise be emulated, the shape of this rod assembly being easily matched to existing mounting assemblies.

There has been described herein a means and a method for holding a beam lead device, such as for example a beam lead diode, on a rod assembly comprised of a beam lead holder and beam lead device. The beam lead rod assembly of this invention secures the beam lead device against damage, and allows convenient handling thereof. In fact, the beam lead rod assembly of this invention is ideally suitable for insertion into coaxial transmission lines, either in series with the center conductor or interconnecting the center conductor and the outer conductor, or even terminating a transmission line.

What is claimed is:

1. A beam lead rod assembly comprising:

a carrier including, a cylindrical dielectric body, and a pair of circumferential conductive coatings disposed on the surface of said body and separated by a circumferential gap of substantially uniform width extending about said body; and a beam lead semiconductor device having a device portion and a pair of oppositely extending leads, said device portion being disposed in said gap and each lead being conductively connected to one of said conductive coatings.

2. A beam lead rod assembly in accordance with claim 1 in which said gap has a width which is greater than the length of said device portion and smaller than the distance between the ends of said leads.

3. A beam lead rod assembly in accordance with claim 1 in which said dielectric body is a ceramic.

4. A beam lead rod assembly in accordance with claim 3 in which said coating has a surface layer of gold.

5. A beam lead rod assembly in accordance with claim 1 in which said dielectric body is a plastic.

6. A beam lead rod assembly in accordance with claim 5 in which said coating has a surface layer of gold.

7. The method of packaging a semiconductive beam lead device comprising the steps of:

depositing a conductive coating of material selectively on the opposite end portions of a dielectric cylindrical body so that facing portions of said coatings form a peripheral circumferential gap whose width is greater than the body portion of the beam lead device to be packaged and less than the distance between the ends of the leads of the beam lead device; and placing the body of the beam lead device into said gap and conductively connecting each beam lead to a different conductive coating.

8. The method of packaging in accordance with claim 7 further including the step of:

applying a protective coating to the exposed surface of said beam lead device in place on the cylindrical body and to at least the immediately adjacent portion of the cylindrical body.

9. The method of packaging a semiconductive beam lead device comprising the steps of:

depositing a conductive coating over the entire surface of a dielectric cylindrical body;

removing a peripheral circumferential portion of said coating to form a continuous gap separating said coating into two portions which are electrically insulated from one another, the width of said gap being selected greater than the length of the beam lead device body portion and smaller than the distance between the ends of the leads of the beam lead device to be packaged; and placing the body of the beam lead device into said gap and conductively connecting each beam lead to a different coating portion.

10. The method of packaging in accordance with claim 9 further including the step of:

applying a protective coating to the exposed surface of said beam lead device in place on the cylindrical body and to at least the immediately adjacent portion of the cylindrical body.

* * * * *